United States Patent [19]

Weirich

[11] Patent Number: 4,552,487

[45] Date of Patent: Nov. 12, 1985

[54] MINE ROOF SUPPORT UNIT HAVING DUST SUPPRESSION MEANS

[75] Inventor: Walter Weirich, Dortmund, Fed. Rep. of Germany

[73] Assignee: Gewerkschaft Eisenhutte Westfalia, Luner, Fed. Rep. of Germany

[21] Appl. No.: 533,361

[22] Filed: Sep. 19, 1983

Related U.S. Application Data

[63] Continuation of Ser. No. 243,658, Mar. 13, 1981, abandoned.

[30] Foreign Application Priority Data

Mar. 19, 1980 [DE] Fed. Rep. of Germany ..... 3010415

[51] Int. Cl.[4] ..... E21D 17/02; E21D 19/00; E21C 47/02

[52] U.S. Cl. ..... 405/295; 405/296; 299/12

[58] Field of Search ..... 405/291–296, 405/299, 302; 299/12, 18, 81; 98/50; 285/133 R

[56] References Cited

U.S. PATENT DOCUMENTS

| | | | |
|---|---|---|---|
| 2,693,950 | 11/1954 | Calder | 299/12 X |
| 2,763,511 | 9/1956 | Berry | 299/12 X |
| 3,859,801 | 1/1975 | Weirich | 405/291 |
| 3,906,733 | 9/1975 | Koppers | 405/296 |
| 3,916,631 | 11/1975 | Agnew et al. | 405/293 |
| 4,075,857 | 2/1978 | Elsner et al. | 405/296 |
| 4,243,268 | 1/1981 | Lobbe et al. | 299/81 X |
| 4,293,247 | 10/1981 | Rosenberg et al. | 405/296 |

*Primary Examiner*—Cornelius J. Husar
*Assistant Examiner*—Nancy J. Stodola
*Attorney, Agent, or Firm*—Maurice E. Gauthier

[57] ABSTRACT

A mine roof support unit has a roof shield for supporting the roof of a mine working, and a goaf shield for screening off the goaf space of the working. The mine roof support unit is provided with dust suppression means constituted by a flat-section spray nozzle arranged along the front edge of the roof shield, or along the top edge of the goaf shield. The spray nozzle is directed upwardly away from the roof support unit and towards the goaf space.

19 Claims, 4 Drawing Figures

31
8
α
11
4
1
36
6
5
7
2
3

8
9
14
11
16
13
4
18
12
21
22
17

16
12
33
4
31
35
32
34
17

MINE ROOF SUPPORT UNIT HAVING DUST SUPPRESSION MEANS

This application is a continuation of application Ser. No. 243,658, filed Mar. 13, 1981, now abandoned.

BACKGROUND TO THE INVENTION

This invention relates to a mine roof support unit having dust suppression means.

Mine roof support units incorporating dust suppression means constituted by spray nozzles are well known. However, the known arrangements have the spray nozzles mounted on the roof support units with the nozzles directed towards the gaps between adjacent units to suppress the dust which falls through these gaps from the roof and goaf space of the mine working. (see DE-OS No. 2 417 223).

The disadvantage of the known arrangements is that the suppression of dust is only tackled after it has begun to accumulate in the upper regions of a mine working, so that some of the dust can be blown, via fissures and cracks in the units, into the access area within the roof support units, where it causes considerable inconvenience.

The aim of the invention is to provide a roof support unit having dust suppression means which tackles the problem of dust in the regions where the dust is created.

SUMMARY OF THE INVENTION

The present invention provides a mine roof support unit having a composite shield for supporting the roof of a mine working and for screening off the goaf space of the working, the mine roof support unit being provided with dust suppression means constituted by at least one spray nozzle arranged on the upper side of the composite shield, the or each spray nozzle being directed upwardly from the composite shield and towards the goaf space.

The positioning of the dust suppression means enables dust to be suppressed at the very places where it is created. This is done by spraying the roof and/or goaf space before fine dust particles trickle down to form dust clouds. It is possible to switch on the spray nozzle(s) as the composite shield is withdrawn, so that the spraying is carried out in a space which is substantially closed-off by the rock face and the shield. Thus, very effective spraying is possible without affecting personnel located in the access area within the roof support unit.

Advantageously, the composite shield is constituted by a roof shield and a goaf shield, the roof shield being for supporting the roof of the mine working, and the goaf shield being for screening off the goaf space of the mine working.

Preferably, the or each nozzle is provided at the front (face-side) edge of the roof shield. Alternatively, the or each spray nozzle is arranged at the top edge of the goaf shield. It is also possible for the dust suppression means to be constituted by at least two spray nozzles, at least one of which is arranged at the top edge of the goaf shield, and at least one of which is provided at the front (face-side) edge of the roof shield. In each case, however, the sprayed hydraulic fluid can flow into the goaf space, and so moisten the largest possible area in a very effective manner.

In a preferred embodiment, there is one spray nozzle, which is positioned nearer one side of the roof shield than the other side. Conveniently, the spray nozzle is positioned approximately $\frac{1}{3}$ of the way along said front edge of the roof shield. Thus, even where the roof support unit has only one spray nozzle, adequate moistening of the gap between that unit and the adjacent roof support unit at said one side is achieved. Obviously, the gap at said other side is moistened by the spray nozzle associated with the roof support unit positioned adjacent thereto.

Where the deposition of dust is likely to be particularly severe, it is recommended that a pair of spray nozzles are provided, the spray nozzles being symmetrically positioned with respect to the centre point of said front edge of the roof shield.

Advantageously, a further spray nozzle is provided along said front edge of the roof shield, the further spray nozzle being directed downwardly from the roof shield and towards the face side of the working. Where there is only one first-mentioned nozzle, the further nozzle and the first-mentioned nozzle may be symmetrically positioned with respect to the centre point of said front edge of the roof shield. The further nozzle is effective to suppress dust in the face region of the working.

Where there is only one first-mentioned nozzle, both this nozzle and the further nozzle may be provided with a common hydraulic fluid supply line. Alternatively, each of the spray nozzles may be provided with a respective hydraulic fluid supply line.

Preferably, the or each spray nozzle is arranged to emit a generally flat-section spray. The jet from such a flat-section spray nozzle is roughly adapted to suit the cross-section that is to be sprayed between the rock face and the shield of the roof support unit. The use of a flat-section spray results not only in uniform moistening, but also in the saving of the hydraulic fluid necessary to provide adequate moistening for effective dust suppression.

Advantageously, the or each spray nozzle is mounted in an elongate strip attached to said front edge of the roof shield. The provision of the elongate strip facilitates the mounting of the spray nozzle(s), as the necessary machining and fitting can be done before the strip is fastened to the roof shield. Preferably, the or each spray nozzle is mounted in a respective support member which is welded into a respective, correspondingly-shaped recess in the elongate strip. Where a further spray nozzle is provided, this may also be mounted in the elongate strip. Conveniently, the further spray nozzle is mounted in a further support member welded into a correspondingly-shaped recess in the elonagate strip. The provision of the welded-in support members facilitates the fitting of the spray nozzle(s), and constitutes a considerable improvement in the manufacture of the apparatus. Preferably, the elongate strip is of circular cross-section. This results in the spray nozzle(s) extending at right-angles to the surface of the strip, which facilitates the machining of the complementary recess(es).

The roof shield may be constituted by a pair of vertically-spaced roof plates. In this case, the or each hydraulic fluid supply line is positioned between the roof plates. Not only does this arrangement result in space-saving, but it also protects the or each hydraulic fluid supply line. Advantageously, the front edge of the upper roof plate is bent downwardly in the region of the or each spray nozzle, thereby defining a pocket housing the mouth of said nozzle. This enables the upper surface of the roof shield to be as flat as possible (which is desirable from the point of view of providing firm roof support over as large an area as possible), whilst defining a respective protective pocket for the or each spray nozzle.

Advantageously, the composite shield is supported by retractable hydraulic props, and wherein control means are provided for supplying the or each spray nozzle with hydraulic fluid only when the hydraulic props are retracted to withdraw the composite shield. Preferably, the roof support unit further comprises a hydraulic advance ram for advancing the roof support unit when the hydraulic props have been retracted, and wherein the control means is such that hydraulic fluid is supplied to the or each spray nozzle only when the hydraulic advance ram is pressurised so as to advance the roof support unit. This results in spraying only occurring when the shield is withdrawn (which is desirable as spraying is most effective at this time), as well as reducing the amount of hydraulic fluid used. The control means may incorporate a hydraulically-operated pilot valve in a hydraulic control line leading from the hydraulic advance ram to the or each spray nozzle.

The invention also provides a mine roof support assembly constituted by a plurality of mine roof support units, each of the mine roof support units being as defined above.

Preferably, the spray nozzles are such and are so positioned that, the sprays emitted by a pair of adjacent spray nozzles meet at a predetermined distance from the front edge of the roof shields.

BRIEF DESCRIPTION OF THE DRAWINGS

A mine roof support unit incorporating dust suppression apparatus, and constructed in accordance with the invention, will now be described, by way of example, with reference to the accompanying drawings, in which.

DESCRIPTION OF PREFERRED EMBODIMENT

Figure 1:
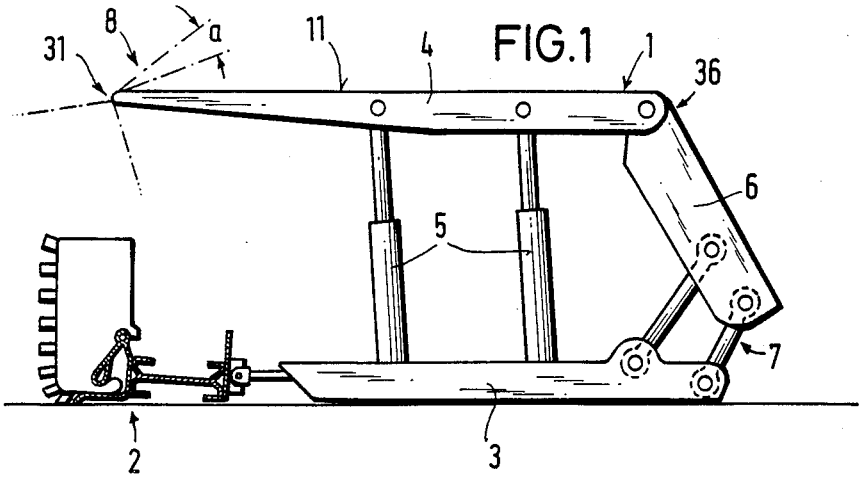
FIG. 1 is a side elevation of the mine roof support unit.

Referring to the drawings, FIG. 1 shows a roof support unit 1 which, together with a plurality of similar roof support units, forms part of a longwall mine roof support assembly. The roof support units are positioned side-by-side along the goaf side of a longwall conveying/winning assembly, generally designated by the reference numeral 2. The roof support unit 1 has a floor sill 3, a roof shield 4, four hydraulic props 5 for supporting the roof shield, and a goaf shield 6. The goaf shield 6 is pivotally attached to the rear (goaf) end of the roof shield 4, and is connected to the floor sill 3 by means of a linkage 7. The roof unit 1 is also provided with dust suppression means 8.

Figure 3:
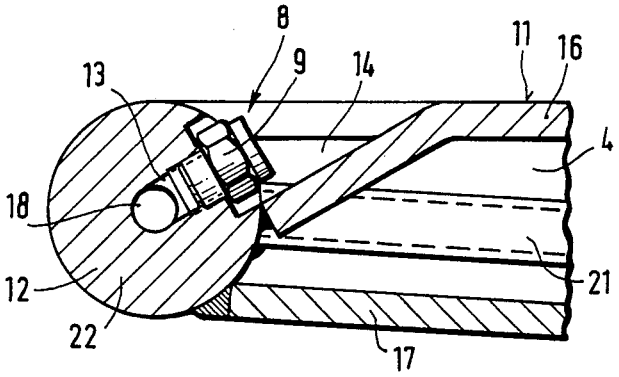
FIG. 3 is a cross-section taken on the line III—III of FIG. 2.
Figure 4:
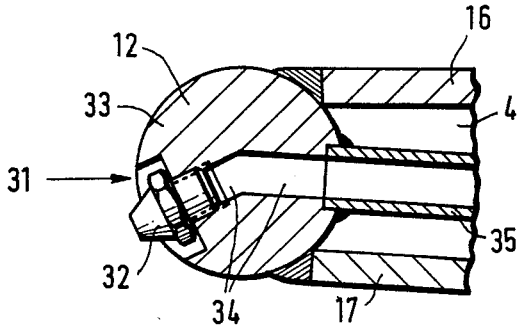
FIG. 4 is a cross-section taken on the line IV—IV of FIG. 2.

The dust suppression means 8 (see FIGS. 2 and 3) comprises a spray nozzle 9, which ejects a generally flat-section spray. The nozzle 9 is mounted in a radial bore 13 formed in a cylindrical end strip 12 attached to the front (face-side) edge 12 of the roof shield 4. As best seen in FIGS. 1 and 3, the nozzle 9 is directed upwardly and towards the goaf. The nozzle 9 is accommodated in a pocket 14, which is formed by bending part of the upper plate 16 of the roof shield 4 downwards (the roof shield being constituted by spaced-apart upper and lower plates 16 and 17 respectively). The nozzle 9 is supplied with hydraulic fluid via a pipe 21 (which is positioned between the two plates 16 and 17 of the roof shield 4), a radial bore 19 formed in the cylindrical end strip 12, and an axial bore 18 formed in the end strip. The bores 13, 18 and 19 are formed in a pre-formed member 22 which is welded into the end strip 12 along weld seams 23.

Figure 2:
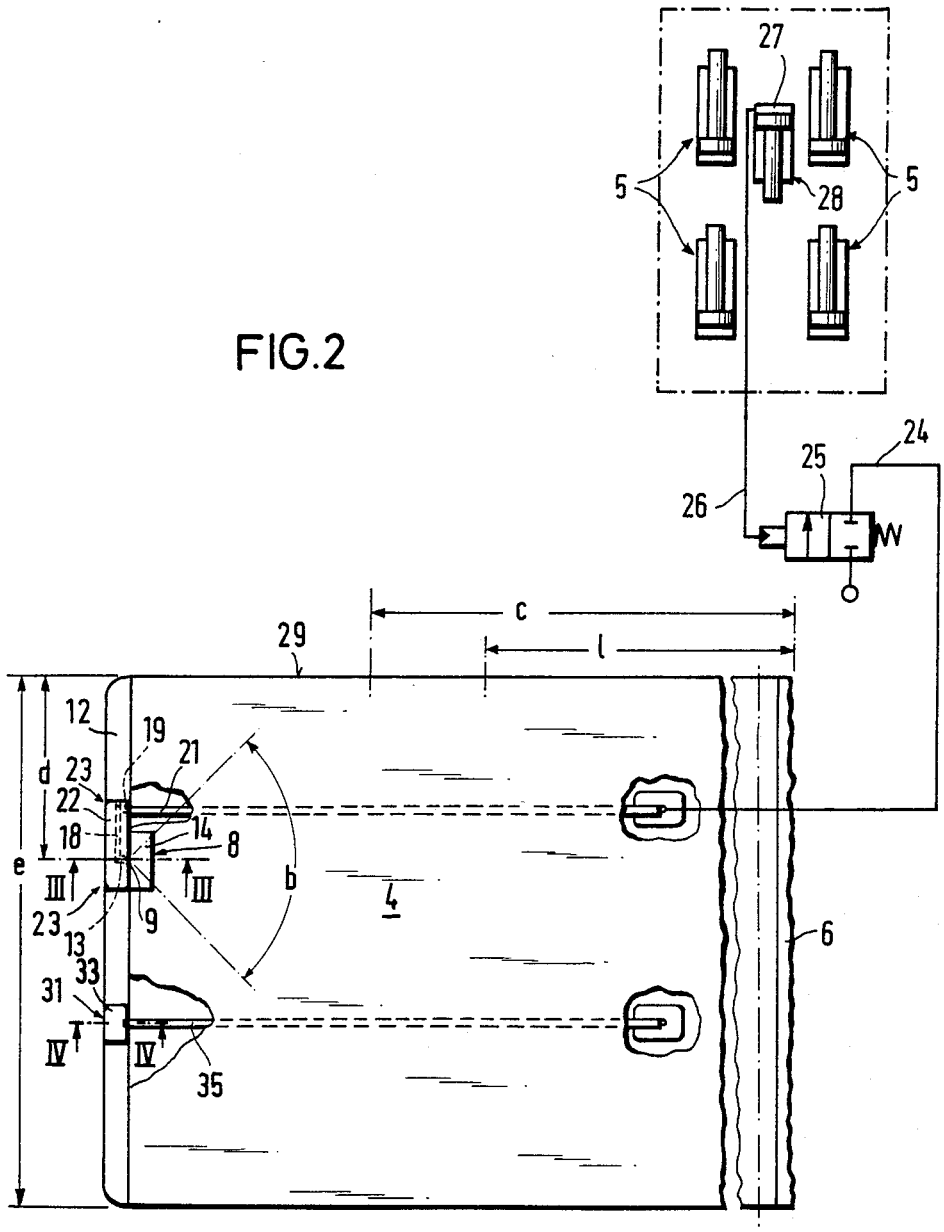
FIG. 2 is a plan view of the mine roof support unit.

As shown schematically in FIG. 2, the pipe 21 communicates with another hydraulic pipe 24, which leads to a hydraulically-controlled pilot valve 25. The pilot valve 25 is controlled, via a hydraulic control line 26, by a work chamber 27 of a hydraulic ram 28. The ram 28 is provided to advance the roof support unit 1 to follow up the advance of the longwall face being won. Thus, as soon as the work chamber 27 is supplied with pressurised hydraulic fluid in order to advance the roof support unit 1, hydraulic fluid passes along the control line 26 to actuate the pilot valve 25. This reverses the position of the pilot valve, from the closed position shown in FIG. 2 to the open position. In this position, hydraulic fluid can pass through the pilot valve 25 from the control line 26 to the line 24, and onto the nozzle 9 which then starts to operate. As soon as the pressure of the hydraulic fluid in the work chamber 27 is reduced, upon completion of the advance movement of the roof support unit 1, the pilot valve 25 (which is spring-biassed towards its closed position) again reverses, cutting off the supply of hydraulic fluid to the nozzle 9.

The vertical angle of divergence a (see FIG. 1) of the spray emitted by the nozzle is relatively small compared with the horizontal angle of divergence b (see FIG. 2). Thus, the nozzle 9 emits what is known as a flat-section spray. The angle b is such that the outer portions of the spray emitted by the nozzle 9 meets the outer portions of the sprays emitted by the nozzles of the adjacent roof support units at a distance c from the goaf-side end of the roof shield 4. The distance c is greater than half the length 1 of the roof shield 4, which ensures that the roof of working is adequately sprayed, as well as the goaf space.

As shown in FIG. 2, the nozzle 9 is positioned a distance d from one side of the roof shield 4, this distance d being about one third the width e of the roof shield. As the nozzles of the other roof support units are similarly positioned, this ensures adequate spraying of the gaps between adjacent roof support units. If necessary, a further nozzle 9 can be positioned about one third of the way along the width of the roof shield 4 from the other side of the roof shield. Preferably, however, a further dust suppression means 31 is positioned at this point, the dust suppression means 31 having a wide-angle nozzle 32 which is directed downwards towards the face being won. The nozzle 32 is mounted in a radial bore 34 formed in a second member 33 welded into a recess in the end strip 12. The nozzle 32 is supplied with hydraulic fluid, via the bore 34, by a hydraulic pipe 35 positioned between the two plates 16 and 17 forming the roof shield 4. A separate control device (not shown) is provided for controlling the supply of hydraulic fluid to the nozzle 32.

It will be apparent that the dust suppression arrangement described above could be modified in a number of ways. In particular, where dust tends to be formed mainly in the goaf space, the dust suppression means 8 is preferably arranged at the upper edge 36 of the goaf shield 6. Obviously, where necessary, the goaf shield 6 of each roof support unit could be provided with two or more dust suppression means 8. It would also be possible to provide the dust suppression means 8 in the rear (goaf-side) edge of the roof shield 4.

I claim:

1. In a mine roof support unit having a generally horizontally disposed roof shield and a rearwardly inclined goaf shield, said roof shield being vertically adjustable between a set position against an overlying roof portion of the mine working and a retracted position spaced therebeneath, and said goaf shield being adapted to screen off a goaf space of the mine working, the improvement comprising: at least one liquid spray nozzle mounted on an upper side of the support unit at a front (face-side) edge of the roof shield and directed upwardly towards said overlying roof portion, and means for spraying liquid through said at least one nozzle while said roof shield is retracted from said overlying roof portion thereby to moisten the same and inhibit the subsequent formation of dust occasioned either by setting the roof shield against said overlying roof portion or by retracting the roof shield therefrom.

2. A roof support unit according to claim 1, wherein said at least one spray nozzle is provided at a front (face-side) edge of the roof shield.

3. A roof support unit according to claim 2, wherein there is one spray nozzle, which is positioned nearer one side of the roof shield than the other side.

4. A roof support unit according to claim 3, wherein the spray nozzle is positioned approximately one third of the distance along said front edge of the roof shield.

5. A roof support unit according to claim 4, wherein a further spray nozzle is provided along said front edge of the roof shield, the further spray nozzle being directed downwardly from the roof shield and towards the face side of the working.

6. A roof support unit according to claim 5, wherein the further nozzle and the first-mentioned nozzle are symmetrically positioned with respect to the centre point of said front edge of the roof shield.

7. A roof support unit according to claim 6, wherein both spray nozzles are provided with a common hydraulic fluid supply line.

8. A roof support unit according to claim 6, wherein each of the spray nozzles is provided with a respective hydraulic fluid supply line.

9. A roof support unit according to claim 1, wherein said at least one spray nozzle is mounted in an elongate strip attached to a front edge of the roof shield.

10. A roof support unit according to claim 9, wherein said at least one spray nozzle is mounted in a respective support member which is welded into a respective, correspondingly-shaped recess in the elongate strip.

11. A roof support unit according to claim 1, wherein said at least one spray nozzle is mounted in an elongate strip attached to a front edge of the roof shield, and wherein a further spray nozzle is provided along said front edge of the roof shield, the further spray nozzle being directed downwardly from the roof shield and towards the face side of the working.

12. A roof support unit according to claim 11, wherein said at least one spray nozzle is mounted in a respective support member which is welded into a respective, correspondingly-shaped recess in the elongate strip, and wherein the further spray nozzle is mounted in a further support member welded into a correspondingly-shaped recess in the elongate strip.

13. A roof support unit according to claim 9, wherein the elongate strip is of circular cross-section.

14. A roof support unit according to claim 7 or claim 9, wherein the roof shield is constituted by a pair of vertically-spaced roof plates.

15. A roof support unit according to claim 14, wherein each hydraulic fluid supply line is positioned between the roof plates.

16. A roof support unit according to claim 14, wherein a front edge of the upper roof plate is bent downwardly in a region of said at least one spray nozzle, thereby defining a pocket housing a mouth of said nozzle.

17. A roof support unit according to claim 1, wherein the composite shield is supported by retractable hydraulic props, and wherein control means are provided for supplying said at least one spray nozzle with hydraulic fluid only when the hydraulic props are retracted to withdraw the composite shield.

18. A roof support unit according to claim 17, further comprising a hydraulic advance ram for advancing the roof support unit when the hydraulic props have been retracted, and wherein the control means is such that hydraulic fluid is supplied to said at least one spray nozzle only when the hydraulic advance ram is pressurised so as to advance the roof support unit.

19. A roof support unit according to claim 18, wherein the control means incorporates a hydraulically-operated pilot valve in a hydraulic control line leading from the hydraulic advance ram to said at least one spray nozzle.

* * * * *